US009901767B2

(12) United States Patent
Kuo

(10) Patent No.: US 9,901,767 B2
(45) Date of Patent: Feb. 27, 2018

(54) EXERCISE TREADMILL CAPABLE OF GENERATING ELECTRICAL POWER

(71) Applicant: SportsArt Industrial Co., Ltd., Tainan (TW)

(72) Inventor: Hai-Pin Kuo, Tainan (TW)

(73) Assignee: SPORTSART INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 15/246,449

(22) Filed: Aug. 24, 2016

(65) Prior Publication Data

US 2017/0333743 A1 Nov. 23, 2017

(30) Foreign Application Priority Data

May 20, 2016 (TW) ..... 105115807 A

(51) Int. Cl.

| | |
|---|---|
| ***A63B 21/00*** | (2006.01) |
| ***A63B 21/005*** | (2006.01) |
| ***A63B 21/22*** | (2006.01) |
| ***A63B 22/02*** | (2006.01) |
| ***A63B 23/04*** | (2006.01) |

(52) U.S. Cl.

CPC ..... *A63B 21/0053* (2013.01); *A63B 21/225* (2013.01); *A63B 22/0235* (2013.01); *A63B 23/04* (2013.01)

(58) Field of Classification Search

None

See application file for complete search history.

(56) References Cited

U.S. PATENT DOCUMENTS

| | | | | |
|---|---|---|---|---|
| 4,616,822 | A * | 10/1986 | Trulaske | A63B 22/02 198/841 |
| 8,864,627 | B2 * | 10/2014 | Bayerlein | A63B 21/0053 482/2 |
| 9,005,085 | B2 * | 4/2015 | Astilean | A63B 22/02 482/54 |
| 9,352,188 | B2 * | 5/2016 | Astilean | A63B 22/02 |
| 2016/0367851 | A1 * | 12/2016 | Astilean | B62K 7/00 |

* cited by examiner

*Primary Examiner* — Stephen R Crow

(57) ABSTRACT

An exercise treadmill includes a machine body, which has at least two rollers, a flywheel linked with one of the two rollers, a support assembly mounted between the two rollers, and a running belt fitted around and engaged with the two rollers and arranged around the support assembly. The exercise treadmill is provided with an accelerating means so that, while a user is walking or running on the machine body, the treading force provided by the user allows the running belt to be accelerated to move around the two rollers for generating electrical power. In addition to improving body heath, the electrical power produced by the treadmill in the training activity can reduce the electrical consumption of city power.

8 Claims, 6 Drawing Sheets

EXERCISE TREADMILL CAPABLE OF GENERATING ELECTRICAL POWER

(A) TECHNICAL FIELD OF THE INVENTION

The present invention relates to an exercise treadmill capable of generating electrical power and, more particularly, to an exercise treadmill which employs the treading force provided by a user to accelerate a running belt to facilitate generation of electrical power.

(B) DESCRIPTION OF THE PRIOR ART

Today, many busy office workers are unable to exercise outdoors due to lack of time, and this may lead to poor health or insufficient physical strength. Thus, various exercise machines, which may be large or small, have been developed for allowing persons to exercise indoors without having to go outdoors. According to the functions provided by an exercise machine, various parts of a human body can be trained properly and adequately. For example, an exercise bike allows users to train their feet through riding action; an exercise treadmill allows users to train their feet through walking or running. For meeting operational or functional requirements, an exercise machine can be provided with various electrical devices, such as a motor for driving a belt at different speeds, or a display panel which allows a user to be aware of information of the exercising activity. For such exercise machines installed with electrical devices, electrical power is indispensible. For large-scale exercise machines, the electricity can be supplied from city power. For small-scale exercise machines, batteries can supply necessary electricity. Since a training activity involved in an exercise machine can produce a certain amount of kinetic energy, it is a pity that the energy is not utilized. Thus, there is a need to develop an exercise machine, especially an exercise treadmill, which can make use of kinetic energy generated in it through a training activity to generate necessary electrical power for the machine.

SUMMARY OF THE INVENTION

One object of the present invention is to provide an exercise treadmill, which comprises a machine body, which includes at least two rollers, a flywheel linked with one of the two rollers, a support assembly mounted between the two rollers, and a running belt fitted around and engaged with the two rollers and arranged around the support assembly. The exercise treadmill is provided with an accelerating means so that, while a user is walking or running on the machine body, the treading force provided by the user allows the running belt to be accelerated to facilitate generation of electrical power.

According to one feature of the present invention, the running belt is provided on its outer surface with a plurality of elongated aluminum plates, which allows a user to tread thereon to facilitate the running belt moving around the two rollers for generating electrical power. In addition to improving body health, the electrical power produced by the treadmill in a training activity can reduce the electrical consumption of city power.

According to another feature of the present invention, each of the elongated aluminum plates is installed at each of its two opposite ends with at least one small roller, which is in rolling contact with the support assembly, so as to reduce the friction between the elongated aluminum plates and the support assembly. In use, while a user is walking or running on the running belt overlaid with the elongated aluminum plates, due to the small rollers installed at the elongated aluminum plates being in rolling contact with the support assembly, the friction between the elongated aluminum plates and the support assembly can be significantly reduced, so that the running belt can be accelerated to move around the two rollers more easily. Furthermore, due to an inclination angle between a bottom of the main frame of the machine body and a floor, while a user is walking or running on the treadmill, the user's weight can be applied to the running belt to facilitate the running belt moving around the two rollers, so that the flywheel can be rotated more easily to generate electrical power. Therefore, the user can exercise on the machine more easily, improve body health, and reduce the electrical consumption of city power.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
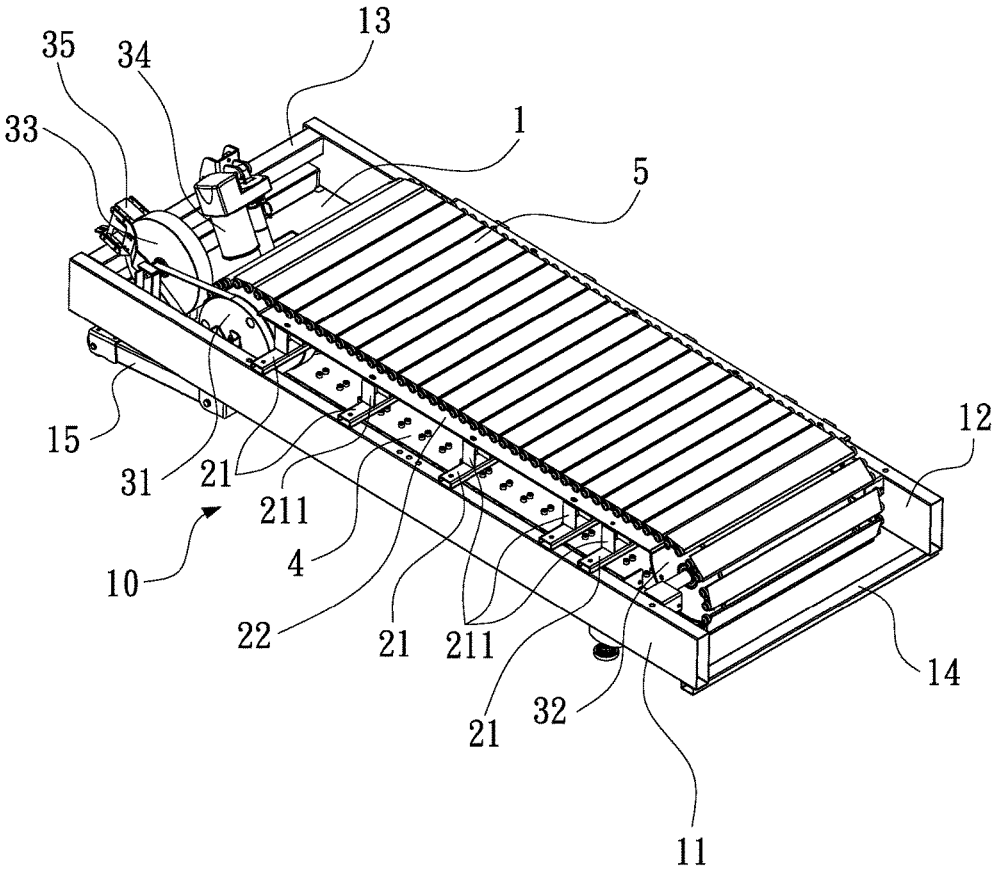
FIG. 1 shows a 3-dimensional view of an exercise treadmill according one embodiment of the present invention.
Figure 2:
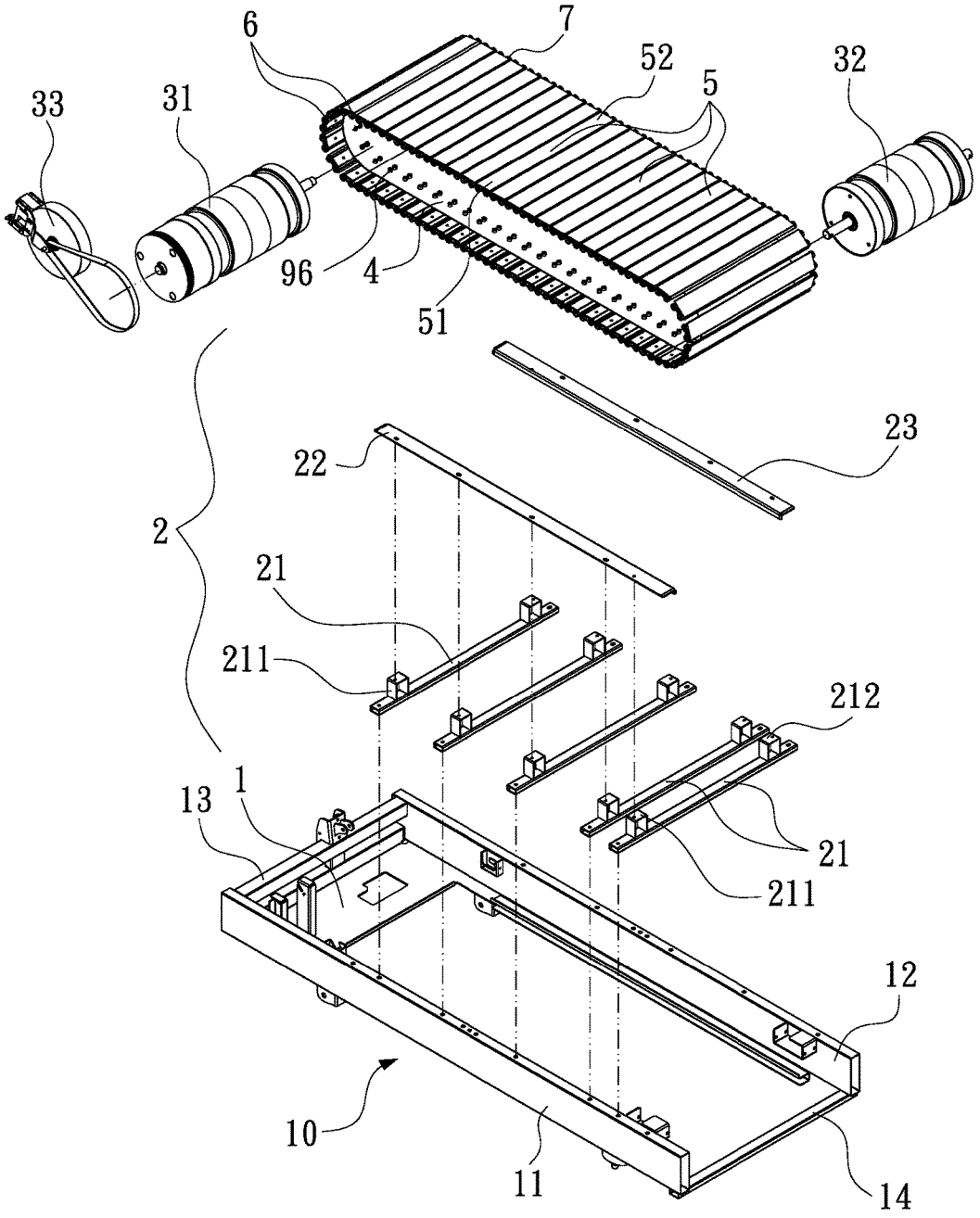
FIG. 2 shows an exploded view of the exercise treadmill.

Referring to FIGS. 1 and 2, an exercise treadmill according to one embodiment of the present invention is shown, which comprises a machine body 10, which generally includes an incline motor 34, a flywheel or inertia wheel 33, a brake unit 35, at least two rollers, a support assembly 2 between the two rollers, and a running belt 4 fitted around and engaged with the two rollers and arranged around the support assembly 2. In particular, the exercise treadmill is provided with an accelerating means, by which, while a user is walking or running on the machine body 10, the treading force provided by the user enables the running belt 4 to be accelerated for generating electrical power.

The running belt 4 is provided on its outer surface with a plurality of elongated aluminum plates 5, which allow a user to tread thereon to facilitate the running belt 4 to move around the two rollers for generating electrical power.

Figure 6:
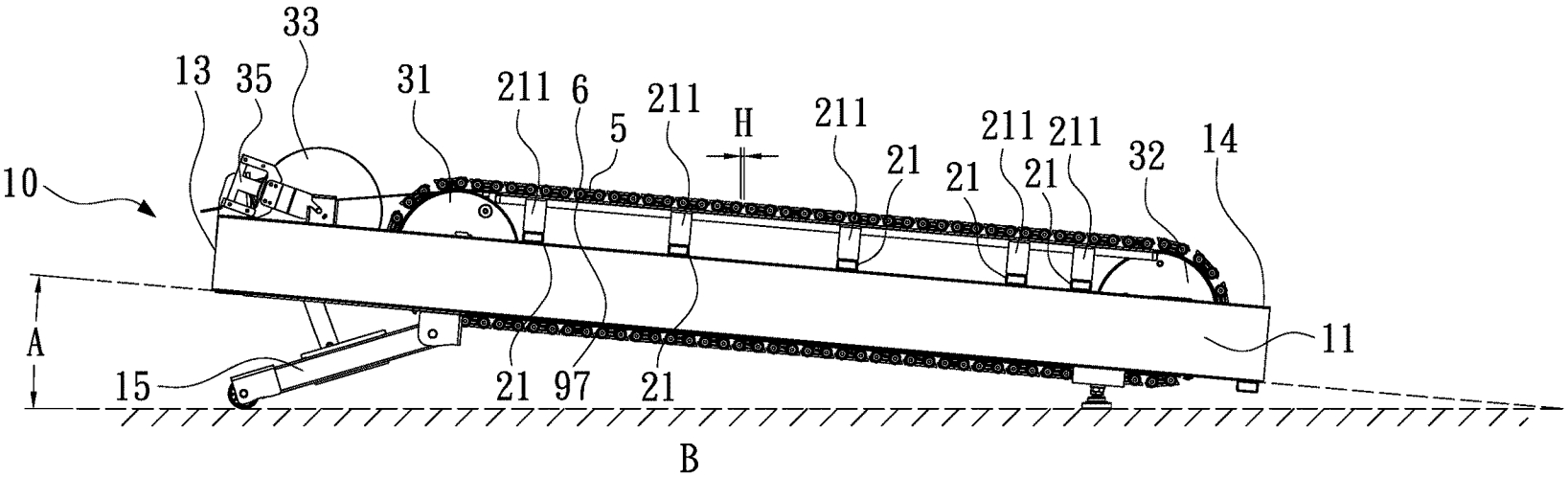
FIG. 6 show a side elevation view of the exercise treadmill, wherein an inclination angle (A) is formed between a bottom of the main frame and a floor (B).

The machine body 10 generally includes a main frame 1 and a base frame 15. The main frame 1 has a left side member 11, a right side member 12, a front side member 13, and a rear side member 14. The two rollers include a front roller 31 and a rear roller 32. In this embodiment, the flywheel 33 is linked with the front roller 31. The front roller 31 is mounted close to the front side member 13 of the main frame 1. The rear roller 32 is mounted close to the rear side member 14 of the main frame 1. The base frame 15, which is generally mounted under the front side member 13 of the main frame 1, can be driven by the incline motor 34 to cause a pivotal movement of the main frame 1, so that an inclination angle (A), greater than zero degree, is formed between a bottom of the main frame 1 and a floor (B) on which the machine body 10 rests (see FIG. 6).

The support assembly 2 includes a plurality of transverse bars 21, a left rail 22, and a right rail 23. The transverse bars 21 are fixed onto the left and right side members 11, 12 of the main frame 1. Each of the transverse bars 21 is provided with a left positioning seat 211 and a right positioning seat 212 respectively at its two opposite ends. The left rail 22 is mounted onto the transverse bars 21 through the left positioning seats 211, while the right rail 23 is mounted onto the transverse bars 21 through the right positioning seats 212. Since the running belt 4 is engaged with the two rollers 31, 32, while a user is walking or running on the elongated aluminum plates 5 provided on the running belt 4, the front and rear rollers 31, 32 can be driven into rotation, which in turn drives the flywheel 33 to rotate so as to generate electrical power. When the speed of the flywheel 33 is too fast, the brake unit 35 may increase motion resistance on the flywheel 33, so that the speed of the flywheel 33 can be reduced, thus preventing a user from a possible danger in a training activity. On the other hand, when the speed of the flywheel 33 is too low, the brake unit 35 may decrease motion resistance on the flywheel 33, so that the speed of the flywheel 33 can be increased.

The brake unit 35 may use an electromagnet to control the speed of the flywheel 33.

Figure 3:
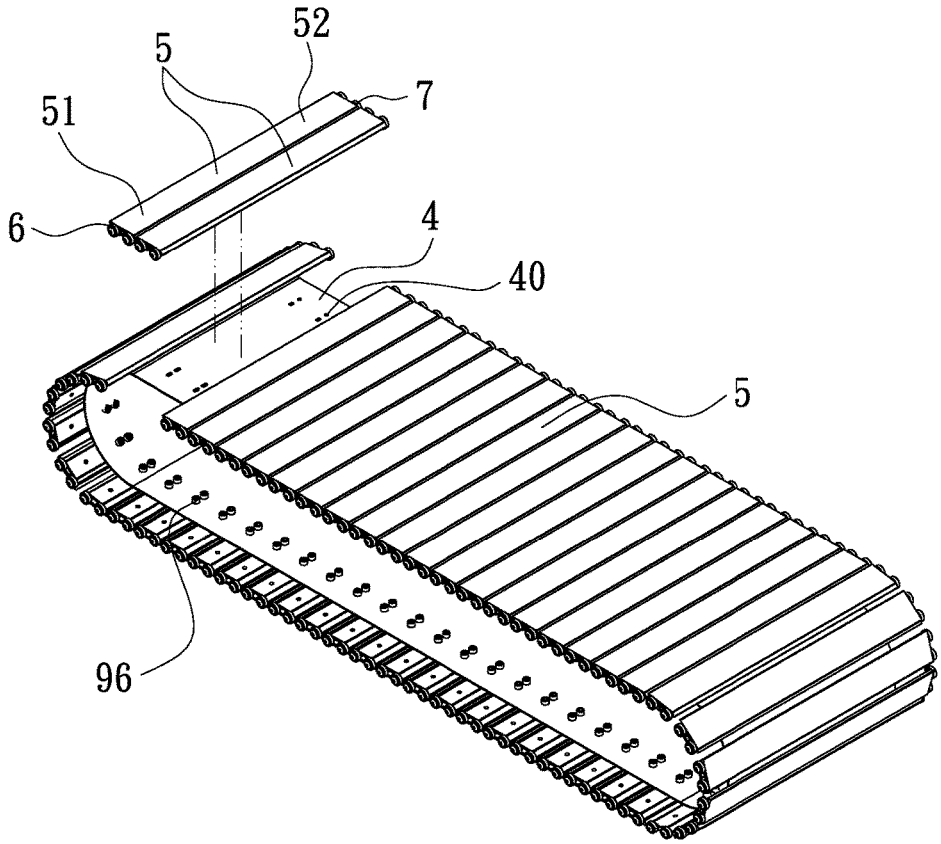
FIG. 3 shows a partially exploded view of a running belt used in the exercise treadmill, wherein the running belt is overlaid with a plurality of elongated aluminum plates.
Figure 4:
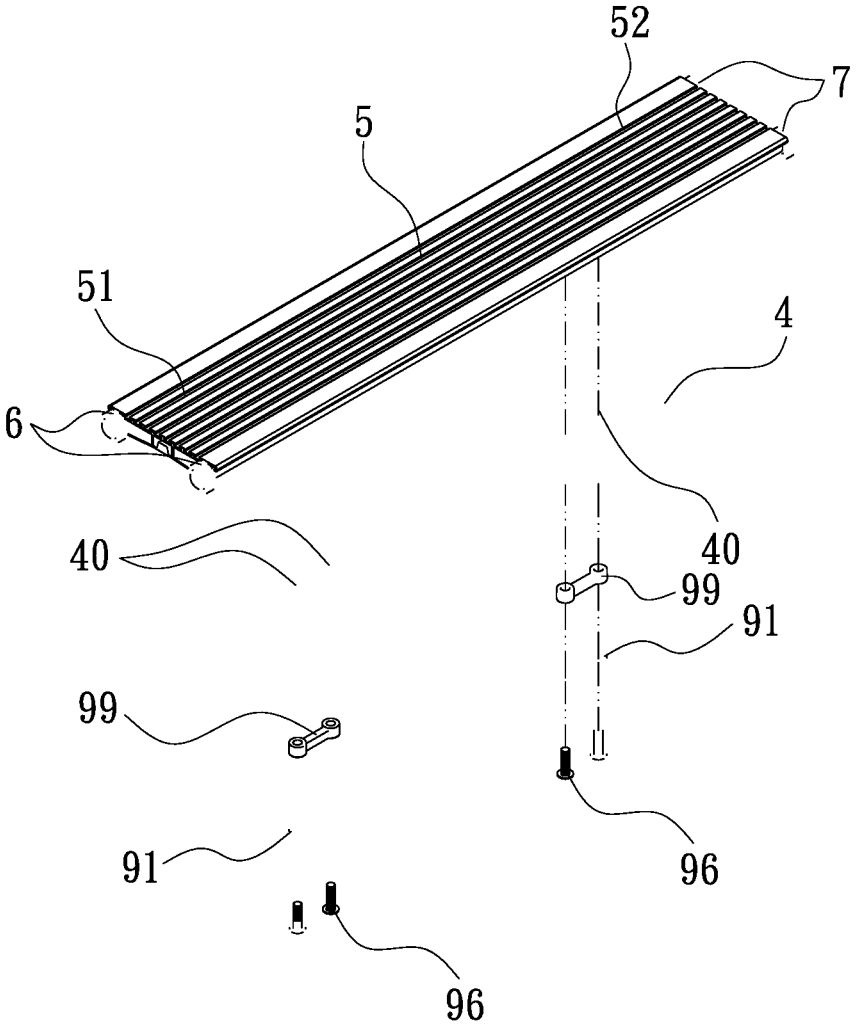
FIG. 4 shows a fragmentary, enlarged, exploded view of the running belt together with the elongated aluminum plates.

Referring to FIGS. 3 and 4, each of the elongated aluminum plates 5 is provided with alternate raised and recessed portions on its outer surface to increase the friction between the elongated aluminum plates 5 and the soles of a user. The running belt 4 defines a plurality of through holes 40 in pairs. Each of the elongated aluminum plates 5 is fixed onto the running belt 4 by using a plurality of fasteners 96 sequentially inserted through washers 91, spacers 99, and the through holes 40 of the running belt 4 into the corresponding elongated aluminum plate 5, wherein each of the spacers 99 defines two holes corresponding to one pair of the through holes 40 of the running belt 4. For the running belt 4, there is a gap (H), greater than zero, between every two adjacent elongated aluminum plates 5 to prevent the elongated aluminum plates 5 from being interfered with each other while the running belt 4 is driven to move around the two rollers 31, 32 (see FIG. 6), so that the exercise treadmill can be operated more smoothly.

Figure 5:
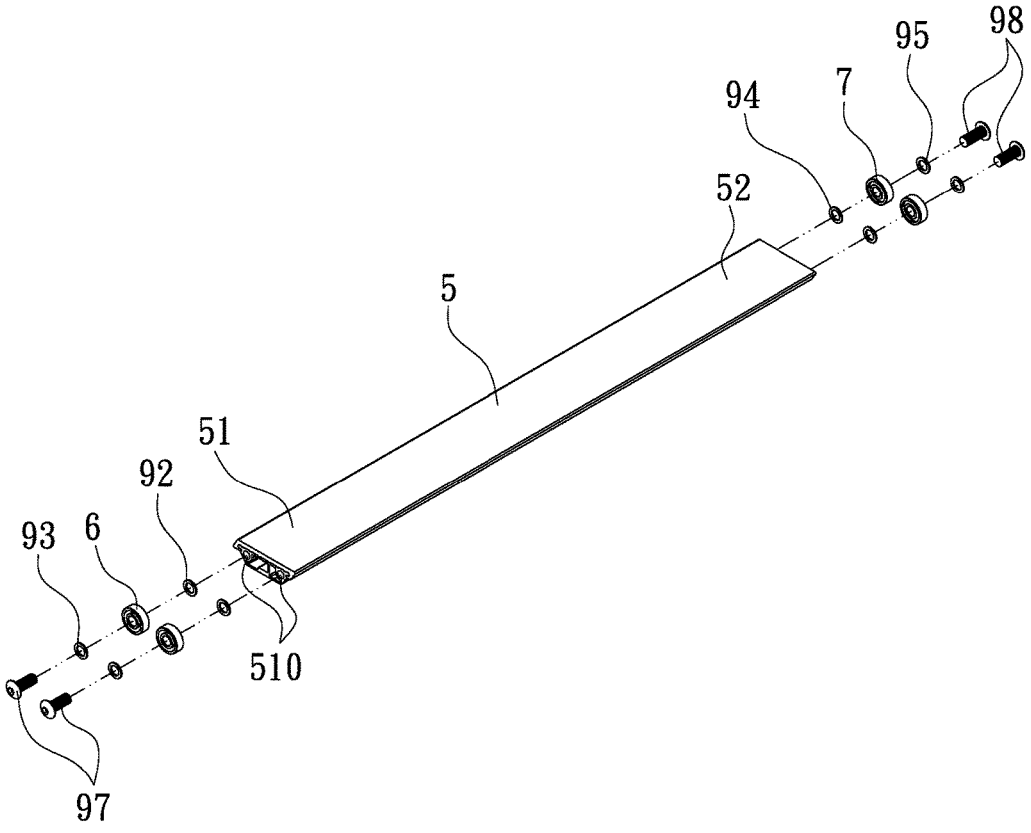
FIG. 5 shows an exploded view of one of the elongated aluminum plates, wherein the elongated aluminum plate is provided with small rollers.

Referring to FIG. 5, each of the elongated aluminum plates 5 is installed at its left end 51 with two small rollers 6, and installed at its right end 52 with two small rollers 7, wherein the small rollers 6, 7 can be made in the form of a bearing to achieve the rolling function. Each of the elongated aluminum plates 5 defines two engagement holes 510 at its left end 51. For installing the two small rollers 6, two fasteners 97 are sequentially inserted two first washers 93, the two small rollers 6, and two second washers 92 to be engaged with the two engagement holes 510 of the elongated aluminum plate 5. Similarly, for installing the two small rollers 7, two fasteners 98 are sequentially inserted through two first washers 95, the two small rollers 7, and two second washers 94 into the right end 52 of the elongated aluminum plates. As such, the small rollers 6, 7 can be placed in rolling contact with the left and right rails 22, 23 of the support assembly 2, respectively, so that the friction between the elongated aluminum plates 5 and the two rails of the support assembly 2 can be reduced. The accelerating means mentioned previously can be achieved by using the small rollers 6, 7 in rolling contact with the left rail 22 and the left rail 23 of the support assembly 2.

In use, while a user is walking or running on the running belt 4 overlaid with the elongated aluminum plates 5, due to the small rollers 6, 7 installed at the elongated aluminum plates 5 being in rolling contact with the left and right rails 22, 23 of the support assembly 2, the friction between the elongated aluminum plates 5 and the rails 22, 23 can be significantly reduced. Thus, the running belt 4 can be accelerated to move around the front and rear rollers 31, 32 more easily. Furthermore, due to the inclination angle (A) between the bottom of the main frame 1 and the floor (B), while a user is walking or running on the treadmill, the user's weight can be applied to the running belt 4 to facilitate the running belt 4 moving around the front and rear rollers 31, 32, so that the flywheel 33 can be rotated more easily to generate electrical power, and the user can exercise on the treadmill, such as walking or running, more easily.

As a summary, the present invention provides a machine body of an exercise treadmill, which includes at least two rollers, a flywheel 33 linked with the two rollers, a support assembly 2 between the two rollers, and a running belt 4 fitted around and engaged with the two rollers and arranged around the support assembly 2. The running belt 4 is provided a plurality of elongated aluminum plates on its outer surface. While a user is walking or running on the machine body, the treading force provided by the user allows the running belt 4 to be accelerated to move around the two rollers to generate electrical power. In addition to improving body health, the electrical power produced by the treadmill in the training activity can reduce the electrical consumption of city power.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. An exercise treadmill including a machine body which has at least two rollers, a flywheel linked with one of the two rollers, a support assembly mounted between the two rollers, and a running belt fitted around and engaged with the two rollers and arranged around the support assembly, wherein the running belt is provided on its outer surface with a plurality of elongated aluminum plates, which allows a user to tread thereon to facilitate the running belt moving around the two rollers.

2. The exercise treadmill of claim 1, wherein the machine body generally includes a main frame and a base frame, the main frame having a left side member, a right side member, a front side member, and a rear side member, the two rollers including a front roller mounted close to the front side member of the main frame, and a rear roller mounted close to the rear side member of the main frame, the flywheel being linked with the front roller, the base frame being generally mounted under the front side member of the main frame and capable of being driven by an incline motor to form an inclination angle (A) between a bottom of the main frame and a floor (B).

3. The exercise treadmill of claim 2, wherein the support assembly includes a plurality of transverse bars, a left rail, and a right rail, the transverse bars being fixed onto the left and right side members of the main frame at their opposite ends, each of the transverse bars being provided with a left positioning seat and a right positioning seat respectively at its two opposite ends, the left rail being mounted onto the transverse bars through the left positioning seats, the right rail being mounted onto the transverse bars through the right positioning seats, whereby while a user is walking or running on the elongated aluminum plates provided on the running belt, the front and rear rollers are driven into rotation, which in turn drives the flywheel linked with the front wheel to rotate.

4. The exercise treadmill of claim 1, wherein the running belt defines a plurality of through holes being arranged in pairs; each of the elongated aluminum plates is provided with alternate raised and recessed portions on its outer surface to increase its friction, and each of the elongated aluminum plates is fixed onto the running belt by using fasteners sequentially inserted through washers, spacers, and the through holes of the running belt into the corresponding elongated aluminum plate, wherein each of the spacers defines two holes corresponding to one pair of the through holes of the running belt.

5. The exercise treadmill of claim 4, wherein every two adjacent elongated aluminum plates defines a gap (H) therebetween to prevent the elongated aluminum plates from being interfered with each other, so that the exercise treadmill can be operated more smoothly.

6. The exercise treadmill of claim 3, wherein each of the elongated aluminum plates is installed at each of its two opposite ends with at least one small rollers, which is in rolling contact with one of the left and right rails of the support assembly, so as to reduce the friction between the elongated aluminum plates and the left and right rails, an accelerating means including the small rollers installed at the elongated aluminum plates and the left and right rails of the support assembly.

7. The exercise treadmill of claim 6, wherein each of the elongated aluminum plates defines at least one engagement hole at each of its two opposite ends, a fastener being sequentially inserted through a first washer, the small rollers, and a second washer to be engaged with the engagement hole of the elongated aluminum plate, so that the small rollers are installed to the elongated aluminum plates.

8. The exercise treadmill of claim 7, wherein the small rollers are made in the form of a bearing.

* * * * *